US009526932B1

(12) United States Patent
Ziaylek et al.

(10) Patent No.: US 9,526,932 B1
(45) Date of Patent: Dec. 27, 2016

(54) STORAGE APPARATUS FOR RETAINING A SUCTION HOSE ON TOP OF AN EMERGENCY VEHICLE

(71) Applicant: Michael P. Ziaylek, Yardley, PA (US)

(72) Inventors: Michael P. Ziaylek, Yardley, PA (US); W. Brian McGinty, Huntingdon Valley, PA (US)

(73) Assignee: Michael P. Ziaylek, Yardley, PA (US)

( * ) Notice: Subject to any disclaimer, the term of this patent is extended or adjusted under 35 U.S.C. 154(b) by 0 days.

(21) Appl. No.: 14/880,508

(22) Filed: Oct. 12, 2015

Related U.S. Application Data

(60) Provisional application No. 62/122,098, filed on Oct. 10, 2014.

(51) Int. Cl.
*A62C 33/04* (2006.01)
*A62C 27/00* (2006.01)

(52) U.S. Cl.
CPC ..... *A62C 33/04* (2013.01); *A62C 27/00* (2013.01)

(58) Field of Classification Search
CPC ..... A62C 33/04; A62C 27/00
USPC ..... 414/462–466, 477, 479, 499–500, 414/522–523, 678; 296/26.09, 26.1; 224/482, 496, 510, 526, 542, 495, 554
See application file for complete search history.

(56) References Cited

U.S. PATENT DOCUMENTS 2,551,351 A * 5/1951 Swenson ..... B60P 3/1025 224/310
2,745,566 A * 5/1956 Bouffard ..... B60P 1/6454 414/494
2,977,011 A * 3/1961 Okerlund ..... B60P 3/1058 414/477
4,234,285 A * 11/1980 Martinez ..... B60R 9/042 224/310
7,137,479 B2 * 11/2006 Ziaylek ..... E06C 5/04 182/127
2011/0250041 A1 * 10/2011 Wissler ..... B66F 11/00 414/546
2012/0263561 A1 * 10/2012 Li ..... B60R 9/0423 414/462

* cited by examiner

*Primary Examiner* — Jeanette E Chapman
(74) *Attorney, Agent, or Firm* — Fox Rothschild LLP

(57) ABSTRACT

A storage apparatus for retaining a suction hose on top of an emergency vehicle which includes a support carriage slidably movable with respect to a tilting assembly secured to the emergency vehicle. In this manner, the hose mounting area is movable between a lower position for placement of the hose in the hose receiving area or removal therefrom to a storage position upwardly in engagement with respect to saddle supports, and an end member attached to the top of the vehicle spatially disposed from the tilting mechanism to facilitate holding of the hose in the storage position.

18 Claims, 6 Drawing Sheets

STORAGE APPARATUS FOR RETAINING A SUCTION HOSE ON TOP OF AN EMERGENCY VEHICLE

This application claims the benefit of U.S. Provisional Application No. 62/122,098, filed on Oct. 10, 2014, the contents of which are incorporated herein by reference.

FIELD OF THE INVENTION

The present invention provides a means for facilitating the storage of suction hoses with respect to an emergency vehicle. Such hoses are commonly somewhat rigid, and as such, cannot be coiled or otherwise condensed dimensionally when stored with respect to an emergency vehicle such as a fire truck. As such, these suction hoses need to remain generally oriented in a longitudinal position without any coiling or folding thereof. The present invention provides a unique construction for storing such devices horizontally above the body of an emergency vehicle such as a fire truck or trailer while allowing controlled movement of the supporting mechanism for holding and retaining of the suction hose between a lower position for replacement or removal, and an upper position for secure storage when the emergency vehicle is moving, often at high speeds to the location of an emergency situation.

BACKGROUND OF THE INVENTION

Various items have been patented covering constructions for storing hoses and other emergency equipment on emergency vehicles such as fire trucks such as shown in U.S. Pat. No. 1,890,940 issued Dec. 13, 1932 to C. H. Fox and assigned to The Ahrens-Fox Fire Engine Company on a. "Fire Engine"; and U.S. Pat. No. 2,492,841 issued Dec. 27, 1949 to C. E. Burkey on a "Pivoted Counterbalanced Car Top Carrier"; and U.S. Pat. No. 2,840,290 issued Jun. 24, 1958 to J. F. Roberts and assigned to Eric Ladd on "Telescopic Ladders"; and U.S. Pat. No. 2,946,397 issued Jul. 26, 1960 to W. A. Berberich on a "Ladder Mount For Vehicles"; and U.S. Pat. No. 3,013,681 issued Dec. 19, 1961 to E. V. Garnett on a "Device For Storage Of Elongated Articles On A. Vehicle"; and U.S. Pat. No. 3,058,607 issued Oct. 16, 1962 to J. T. Kiley and assigned to James A. Kiley Company on "Ladder Racks"; and U.S. Pat. No. 3,357,578 issued Dec. 12, 1967 to J. O. Koenig on a "Boat Carrier For Pickup Mounted Camper Coaches; and U.S. Pat. No. 3,672,549 issued Jun. 27, 1972 to A. J. Chorey on a "Car Top Carrier And Access Ladder"; and U.S. Pat. No. 3,715,044 issued Feb. 6, 1973 to G. A. Simons on a "Roof Mounted Carrier For Automotive Vehicles"; and U.S. Pat. No. 3,720,334 issued Mar. 13, 1973 to A. A. Permut et al on "Boat And Equipment Loading Systems"; and U.S. Pat. No. 3,877,624 issued Apr. 15, 1975 to M. T. Carson on a "Vehicle Top Rack"; and U.S. Pat. No. 3,963,136 issued Jun. 15, 1976 to Theodore J. Spanke on a "Retractable Ladder Track"; and U.S. Pat. No. 4,008,838 issued Feb. 22, 1977 to R. R. Correll on a "Ladder Rack"; and U.S. Pat. No. 4,062,464 issued Dec. 13, 1977 to R. E. Grove on "Mounting Brackets For An Article Handling Apparatus"; and U.S. Pat. No. 4,062,464 issued Dec. 13, 1977 to R. E. Grove on "Mounting Brackets For An Article Handling Apparatus"; and U.S. Pat. No. 4,170,331 issued Oct. 9, 1979 to E. W. Faulstich on a "Vehicle Ladder Rack"; and U.S. Pat. No. 4,262,834 issued Apr. 21, 1981 to W. H. Nutt and assigned to Teledyne Canada Limited on a "Ladder Rack"; and U.S. Pat. No. 4,751,981 issued Jun. 1, 1988 to J. C. Mitchell et al on a "Detachably Mounted Ladder Rack"; and U.S. Pat. No. 4,808,056 issued Feb. 28, 1989 to S. Oshima. on an "Elevator Device Transportable In. A Motor Vehicle"; and U.S. Pat. No. 4,826,387 issued May 2, 1989 to M. Audet on a "Vehicle Roof Rack"; and U.S. Pat. No. 4,827,742 issued May 9, 1989 to R. R. McDonald and assigned to Unistrut Australia Pty. Ltd. on a "Security Assembly For Vehicle Roofrack"; and U.S. Pat. No. 4,858,725 issued Aug. 22, 1989 to L. H. Griffin on a "Ladder Brace"; and U.S. Pat. No. 4,877,108 issued Oct. 31, 1989 to L. H. Griffin et al on a "Hydraulic Ladder Brace"; and U.S. Pat. No. 4,887,750 issued Dec. 19, 1989 to R. K. Dainty and assigned to British Gas plc on a "Rack Arrangement"; and U.S. Pat. No. 4,923,103 issued May 8, 1990 to C. J. Sauber on a "Ladder Rack"; and U.S. Pat. No. 4,953,757 issued Sep. 4, 1990 to S. R. Stevens et al on a "Front Rack For A Truck"; and U.S. Pat. No. 5,009,350 issued Apr. 23, 1991 to J. M. Schill et al on "Retainer Assemblies For Elongated Objects"; and U.S. Pat. No. 5,048,641 issued Sep. 17, 1991 to J. N. Holcomb et al and assigned to Jack N. Holcomb on a "Van-Mounted Ladder Assembly With Concealed Radio Antennas"; and U.S. Pat. No. 5,058,791 issued Oct. 22, 1991 to K. R. Henriquez et al and assigned to Slide-Out, Inc. on a "Vehicular Ladder Rack"; and U.S. Pat. No. 5,071,303 patented Dec. 10, 1991 to J. Tibbet on an "Apparatus For Loading And Carrying Boats"; and. U.S. Pat. No. 5,104,280 issued Apr. 14, 1992 to M. P. Ziaylek et al and assigned to Michael P. Ziaylek on an "Apparatus For Use With An Emergency Vehicle For Storage And Retrieval Of Remotely Located Emergency Devices"; and U.S. Pat. No. 5,154,563 issued Oct. 13, 1992 to S. R. Phillips on a "Wheel Chair Carrier"; and. U.S. Pat. No. 5,172,952 patented Dec. 22, 1992 to R. Lasnetski on an "Overhead Storage Rack For Storing Ladders Or The Like"; and U.S. Pat. No. 5,240,078 issued Aug. 31, 1993 to R. F. Worthington and assigned to Navajo Refining Company on a "Mobile Modular Foam Fire Suppression Apparatus, System and Method"; and U.S. Pat. No. 5,297,912 issued Mar. 29, 1994 to A. Y. Levi and assigned to JAJ Products, Inc. on a "Ladder Rack For Motor Vehicles"; and U.S. Pat. No. 5,360,150 issued Nov. 1, 1994 to Jean-Luc Prat on a "Roof Rack For Vehicles"; and U.S. Pat. No. 5,398,778 issued Mar. 21, 1995 to R. Sexton on a "Ladder Rack Securing and Release System"; and U.S. Pat. No. 5,405,234 issued Apr. 11, 1995 to T. Ziaylek, Jr. et al on a "Pivotable Article Retaining Apparatus To Invert and Store A Collapsible Water Storage Tank On A Vehicle"; and U.S. Pat. No. 5,421,495 issued Jun. 6, 1995 to L. Bubik et al and assigned to Innovative Bicycle Design Inc. on a "Vehicle Roof Rack"; and U.S. Pat. No. 5,469,933 issued Nov. 28, 1995 to J. Thomason on a "Vehicle Mounted Ladder"; and U.S. Pat. No. 5,632,591 issued May 27, 1997 to K. R. Henriquez on a "Ladder Storage And Transport Device"; and U.S. Pat. No. 5,743,703 issued Apr. 28, 1998 to M. J. Gunderson on a "Method And Apparatus For A Vehicle Mounted Hoisting System"; and U.S. Pat. No. 5,791,857 issued Aug. 11, 1998 to T. Ziaylek, Jr. et al and assigned to Theodore Ziaylek, Jr. and Michael Paul Ziaylek on an "Automatic Ladder Lowering And Storage Device For Use With An Emergency Vehicle"; and U.S. Pat. No. 5,850,891 issued Dec. 22, 1998 to J. J. Olms et al and assigned to Trimble Navigation Limited on a "Motorized Rack System"; and U.S. Pat. No. 6,029,750 issued Feb. 29, 2000 to B. E. Carrier on an "All Terrain Fire-Fighting Vehicle"; and U.S. Pat. No. 6,099,231 issued Aug. 8, 2000 to A. Y. Levi on a "Drive Unit For Motor Vehicle Ladder Rack"; and U.S. Pat. No. 6,257,534 patented Jul. 10, 2001 to A. L. Finley and assigned to Fibre Body Industries INC on a "Ladder Rack Assembly"; and U.S. Pat.

No. 6,273,668 patented Aug. 14, 2001 to F. Kameda and assigned to Nissin Jidosha Kugyo Co., Ltd. on a "Wheel Chair Storage Apparatus Of Car"; and. U.S. Pat. No. 6,315,181 patented Nov. 13, 2001 to J. A. Bradley et al and assigned to Adrian Steel Company on a "Ladder Rack Apparatus And Method"; and U.S. Pat. No. 6,321,873 patented Nov. 27, 2001 to R. LaBrash and assigned to Tra-Lor-Mate, Inc. on a "Ladder Mounting System"; and U.S. Pat. No. 6,360,930 patented Mar. 26, 2002 to M. Flickenger and assigned to L & P Property Management Company on a "Vehicle Rack Assembly With Hydraulic Assist"; and U.S. Pat. No. 6,427,889 patented Aug. 6, 2002 to A. Y. Levi on a "Ladder Rack For Hi Bay Vans"; and U.S. Pat. No. 6,561,396 patented May 13, 2003 to C. A. Ketterhagen and assigned to Johnson Outdoors Inc. on. an "Automobile Cargo Carrier System"; and U.S. Design Pat. No. D487,049 patented Feb. 24, 2004 to T. Ziaylek, Jr. on an "Apparatus For Retaining Elongated Objects Relative To A Vehicular Body And Providing Access Thereto"; and U.S. Pat. No. 6,827,541 patented Dec. 7, 2004 to M. P. Ziaylek et al on an "Apparatus For Holding Elongated Objects Horizontally Adjacent To A Vehicular Body Which Is Movable Between An Upper Storage Position And A Lower Access Position"; and U.S. Pat. No. 6,854,627 patented Feb. 15, 2005 to B. Foo et al and assigned to eRack LLC on a "Vehicular Utility Rack"; and U.S. Pat. No. 6,874,835 patented Apr. 5, 2005 to L. A. Silverness on a "Collapsible Rack For Storing Ladders And The Like On A Land Vehicle"; and U.S. Pat. No. 6,883,815 patented Apr. 26, 2005 to D. W. Archer and assigned to Oshkosh Truck Corporation on a "Fire-Fighting Vehicle"; and U.S. Pat. No. 6,929,162 patented Aug. 16, 2005 to L. R. Jordan on an "Automatic Locking Ladder Rack"; and U.S. Pat. No. 6,983,767 patented Jan. 10, 2006 to L. M. Rickards and assigned to Action Coupling and Equipment, Inc. on a "Sleeve For A Hose" and U.S. Pat. No. 7,097,409 patented Aug. 29, 2006 to T. S. Richter and assigned to Adrian Steel Co. on a "Ladder Rack System"; and U.S. Pat. No. 7,137,479 patented Nov. 21, 2006 to M. P. Ziaylek et al and assigned to Michael P. Ziaylek, Theodore Ziaylek, Jr. and Theodore P. Ziaylek on a "Powered Ladder Storage Apparatus For An Emergency Vehicle"; and U.S. Pat. No. 7,210,559 patented May 1, 2007 to D. R. Hickey and assigned to Cross Tread Industries, Inc. on an "Apparatus And Method For Holding/Locking A Ladder Or Other Object To A Structure"; and U.S. Design Pat. No. D545,263 patented Jun. 26, 2007 to M. P. Ziaylek et al and assigned to Michael P. Ziaylek, Theodore Ziaylek, Jr. and Theodore P. Ziaylek on a "Powered Ladder Storage Apparatus For Use With A Vehicle"; and U.S. Pat. No. 7,331,586 patented Feb. 19, 2008 to C. M. Trinkner et al and assigned to Pierce Manufacturing Company on a "Vehicular Storage System"; and U.S. Pat. No. 7,341,418 patented Mar. 11, 2008 to H. Ito and assigned to Sato Kogyosyo Co., Ltd. on a "Vehicle Equipped With Lift Device And Lift Device"; and U.S. Pat. No. 7,464,972 patented Dec. 16, 2008 to R. D. Niemletz on an "Air Evacuation Attachment For Fire Hoses"; and U.S. Design Pat. No. D585,011 patented Jan. 20, 2009 to M. P. Ziaylek on a "Ladder Storing Apparatus For Use Within An Emergency Vehicle"; and U.S. Pat. No. 7,30,403 patented May 12, 2009 to M. J. Cano and assigned to City of Hialeah on a "Transport Pumper"; and U.S. Pat. No. 7,549,831 patented Jun. 2, 2009 to J. H. Hendley et al and assigned to L & P Property Management on a "Ladder Rack Apparatus and Method"; and U.S. Pat. No. 7,758,091 patented Jul. 20, 2010 to D. A. McCall on a "Collapsible Ladder Rack System For Vehicles"; and U.S. Pat. No. 7,784,554 patented Aug. 31, 2010 to C. Grady et al and assigned to Pierce Manufacturing Company on a "Firefighting Vehicle"; and U.S. Pat. No. 7,909,112 patented Mar. 22, 2011 to G. M. Decker on a "Compact Mobile Fire Attack Vehicle Mountable To An Emergency Vehicle"; and U.S. Pat. No. 7,992,682 patented Aug. 9, 2011 to M. P. Ziaylek on a "Ladder Storing Apparatus For Use With An Emergency Vehicle"; and U.S. Publication No. 2013/0322997 published Dec. 5, 2013 to M. P. Ziaylek et al and assigned to Michael P. Ziaylek on a "Remote Equipment Storage Apparatus With Downwardly Extendable Retrieval Position". Each of the cited references is incorporated herein by reference.

SUMMARY OF THE INVENTION

In at least one embodiment, the present invention provides a storage apparatus for retaining a rigid or semi-rigid hose, such as a suction hose, with respect to the body of emergency vehicles securely.

In at least one embodiment, the present invention provides a storage apparatus for retaining a suction hose on top of an emergency vehicle which facilitates movement of a support carriage between a lower loading and unloading position and an upper storage position easily and with limited force requirements.

In at least one embodiment, the present invention provides a storage apparatus to retaining a suction hose on top of an emergency vehicle which facilitates movement of a support carriage between a lower loading and unloading position and an upper storage position easily and with only use of manual operation of a handle which can easily be performed by a single emergency worker.

In at least one embodiment, the present invention provides a storage apparatus for retaining a suction hose on top of an emergency vehicle in a manner which does not require bending or coiling of the hose such as to allow the hose to extend generally longitudinally when stored and retrieved.

In at least one embodiment, the present invention provides a storage apparatus for retaining a suction hose on top of an emergency vehicle which facilitates storage of rigid and semi-rigid hoses, such as suction hoses, with respect to any type of emergency vehicle which includes a generally planar upper surface or other similar mounting surface which is sufficiently secure during movement of the emergency vehicle.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
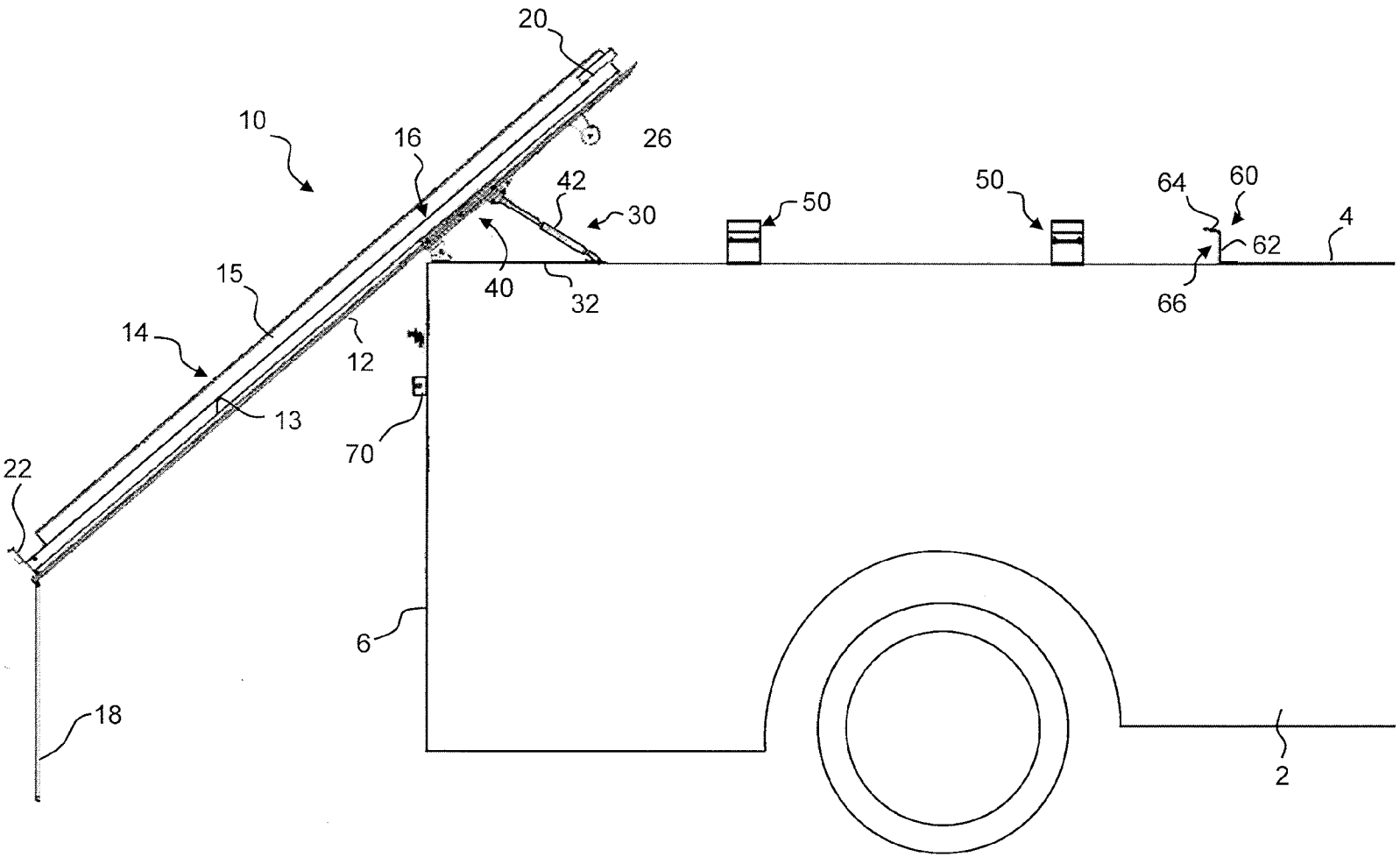
FIG. 1 is a side plan view of an embodiment of the storage apparatus for retaining a suction hose on top of an emergency vehicle showing the apparatus in the lower position to facilitate loading and/or unloading with respect to the hose receiving area.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIGS. 1-6, a storage apparatus 10 in accordance with an exemplary embodiment of the invention will be described. The storage apparatus 10 is for the purpose of retaining a somewhat rigid hose 100 (see FIG. 4), such as a conventional suction hose, on top of an emergency vehicle 2, such as a fire truck or fire trailer. Typically, the fire truck 2 or equivalent includes a generally horizontally extending vehicle body top 4 and a generally vertically extending vertical body panel 6 thereadjacent. The storage apparatus 10 secures the hose 100 such that it is moveable between a storage position (see FIG. 2) on the vehicle body top 4 and a loading/unloading access position (See FIG. 1) lowered from the vehicle body top 4 to facilitate rapid removal and replacement thereof as needed.

In the illustrated embodiment, the storage apparatus 10 includes a support carriage 12 with a support tray 14 secured to the upper facing surface thereof. The support carriage 12 is the main structural member which supports the hose 100 thereabove. The support tray 14 is preferably of aluminum material and is approximately L-shaped in cross-section. The L-shaped configuration includes a horizontal support surface 13 extending along the support carriage 12 and a side wall 15 with a hose receiving area 16 defined therewithin. The side wall 15 helps to prevent side to side movement of the hose 100 when it is supported by the storage apparatus 10. A handle 18 is pivotally connected to the rearward end of the support carriage 12 and a guide wheel 26 is provided on a lower surface toward the forward end thereof, both to facilitate movement of the carriage 12 as will be described in more detail hereinafter.

Figure 4:
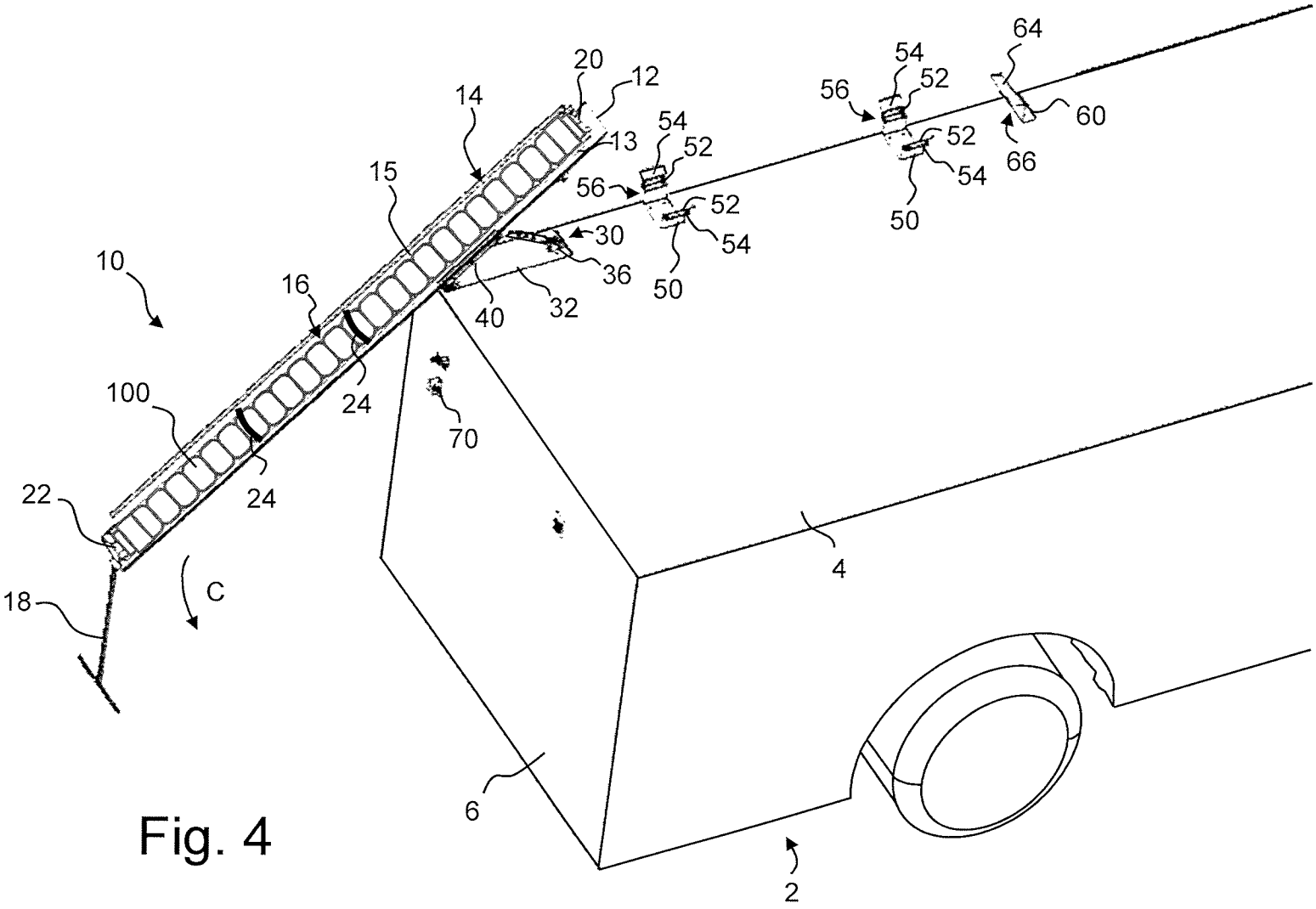
FIG. 4 is a three-quarter perspective view of an embodiment of the present invention shown positioned in the lower access position to facilitate loading and/or unloading of a suction hose.

One or more retaining means may be included to further secure the hose 100 within the receiving area 16. At the forward end, toward the cab of the fire truck 2, a v-shaped flexible retaining member 20 extends from the side wall 15. The v-shaped retaining member 20 is configured to extend into an open end of the hose 100. The length at which the v-shaped retaining member 20 extends from the forward end of the support tray 14 provides a tolerance to facilitate hoses 100 of varying lengths. At the rearward end of the support tray 14, a generally flat retaining member 22 extends from the side wall 15 and across the receiving area 16. The flat retaining member 22 is preferably flexible to allow movement thereof to facilitate removal and insertion of the hose within the receiving area 16. FIG. 4 shows additional optional retaining means in the form of straps 24, bungee cords or the like which extend from the side wall 15 to the support surface 13 to further retain the hose 100 in the receiving area 16. The straps 24 are preferably positioned toward the rearward end of the support tray 14 such that they are easily accessible when the storage carriage 12 is in the loading/unloading access position.

Figure 5:
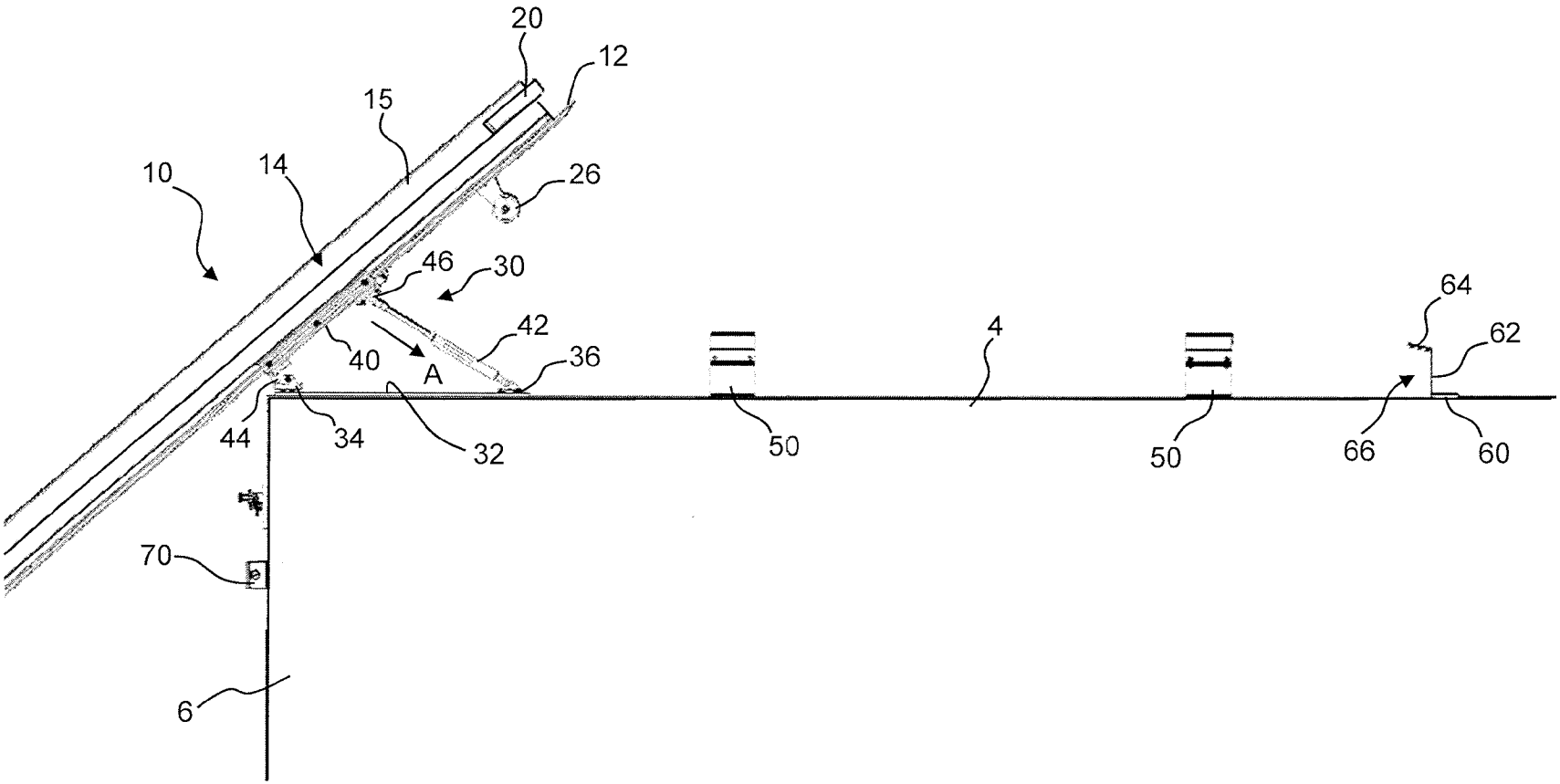
FIG. 5 is an expanded view of an embodiment of the storage apparatus for retaining a suction hose on the top of an emergency vehicle of the present invention for the purpose of displaying the details of this embodiment of the construction of the tilting mechanism which includes a tilting base, a tilting table, a table slot, a tilting hinge and a tilting control mechanism which is longitudinally extendable.
Figure 6:
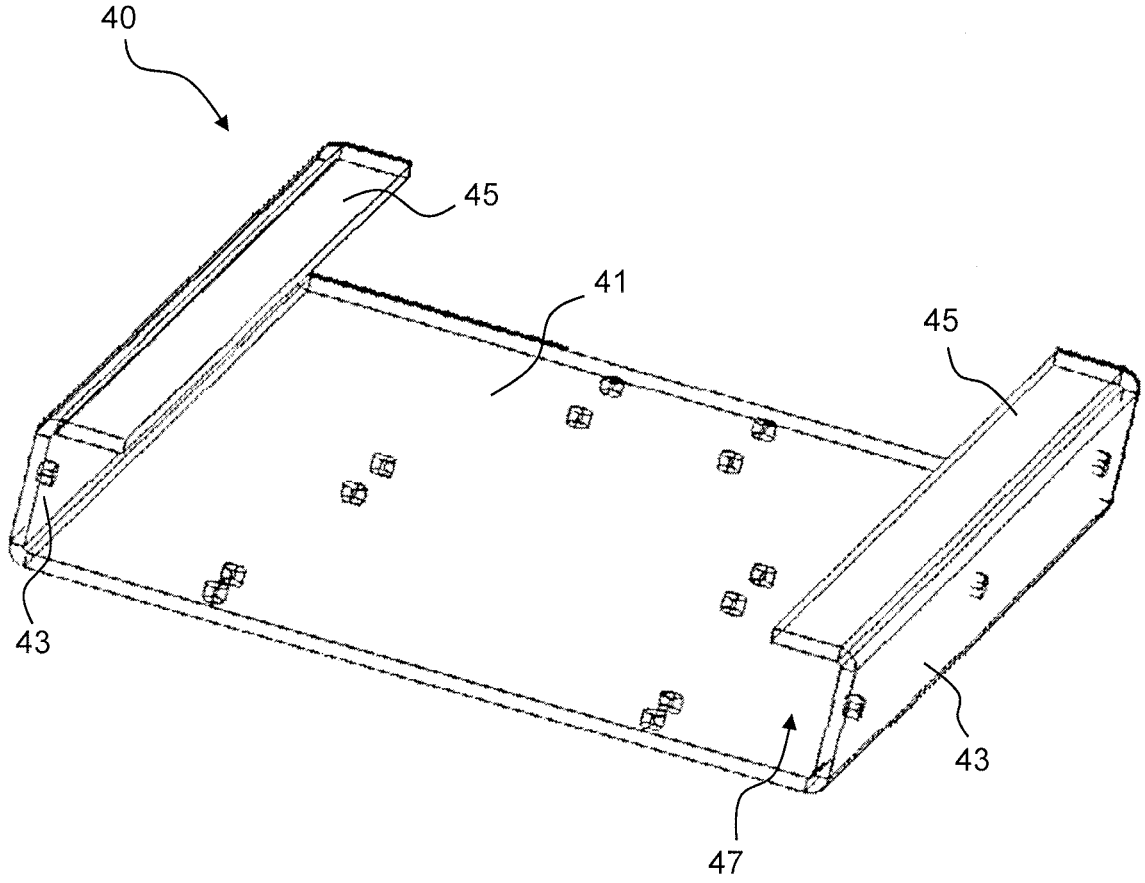
FIG. 6 is an isometric view of an exemplary guide track in accordance with an embodiment of the invention.

Referring to FIGS. 4-6, to facilitate movement and tilting of the storage carriage 12 from the storage position to the access position, the storage apparatus 10 includes a tilting assembly 30. The tilting assembly 30 includes a base plate 32 which is secured to the vehicle body top 4 adjacent to the vertical body panel 6. A pair of spaced apart pivot mounts 34 and 36 extend upward from the base plate 32 and pivotally supported the tilting guide track 40. Each pivot mount described herein may be a single mount or more than one mount, for example, two mounts laterally separated to support both sides of the guide track 40. The rearward end of the guide track 40 includes a pivot mount 44 which aligns with and is pivotally connected to the pivot mount 34 of the base plate 32 such that the guide track 40 is pivotal relative to the fixed base plate 32. The forward end of the guide track 40 includes a second pivot mount 46 and in the illustrated embodiment, a telescoping member 42 extends between the mounts 36 and 46 to assist in maintaining proper alignment of the tilting track 40. It is further contemplated that the telescoping member 42 may include an internal pneumatic chamber (not shown) which facilitates dampening of movement of the storage carriage 12 when moving between the storage position and the access position to prevent sudden or rapid unwanted movement thereof. Furthermore, a spring can be configured within the telescoping member 42 which is operative to exert a continuous retracting force on the telescoping member 42, as indicated by arrow A in FIG. 5, to provide an assisting force in support of the manual lifting of the support carriage 12 from the access position to the storage position.

An exemplary embodiment of the guide track 40 is illustrated in FIG. 6. The guide track 40 includes a base surface 41 with a pair of opposed side walls 43. A return 45 extends inward from each side wall 43 such that a guide slot 47 is defined between the base surface 41, the side walls 43 and the returns 45. The guide slot 47 is sized such that the support carriage 12 is retained therein while remaining moveable therealong.

When the storage carriage 12 is moved to the storage position, the tiling assembly 30 remains fixed and the storage carriage 12 moves forward relative thereto. To support the forward end of the storage carriage 12 and prevent lateral movement thereof, one or more saddle supports 50 are preferably secured to the vehicle body top 4 forwardly of the tilting assembly 30. Each saddle support 50 includes a pair of spaced apart horizontal support shoulders 52 with a respective retaining wall 54 extending upward therefrom such that a carriage receiving slot 56 is defined. When in the storage position, the carriage 12 is vertically supported on the shoulders 52 and prevented from lateral movement by the retaining walls 54.

To limit movement of the support carriage 12 forwardly with respect to the vehicle body 2, an end bracket 60 is preferably positioned at the approximate forwardmost position of the support carriage 12 when carriage 12 is in the storage position. This end bracket 60 preferably includes an extension 62 extending from the vehicle body top 4 and an upper tab 64 extending therefrom, substantially parallel to the vehicle body top 4 such that a docking cavity 66 adapted to receive the forwardmost portion of the support carriage 12 is defined.

Figure 2:
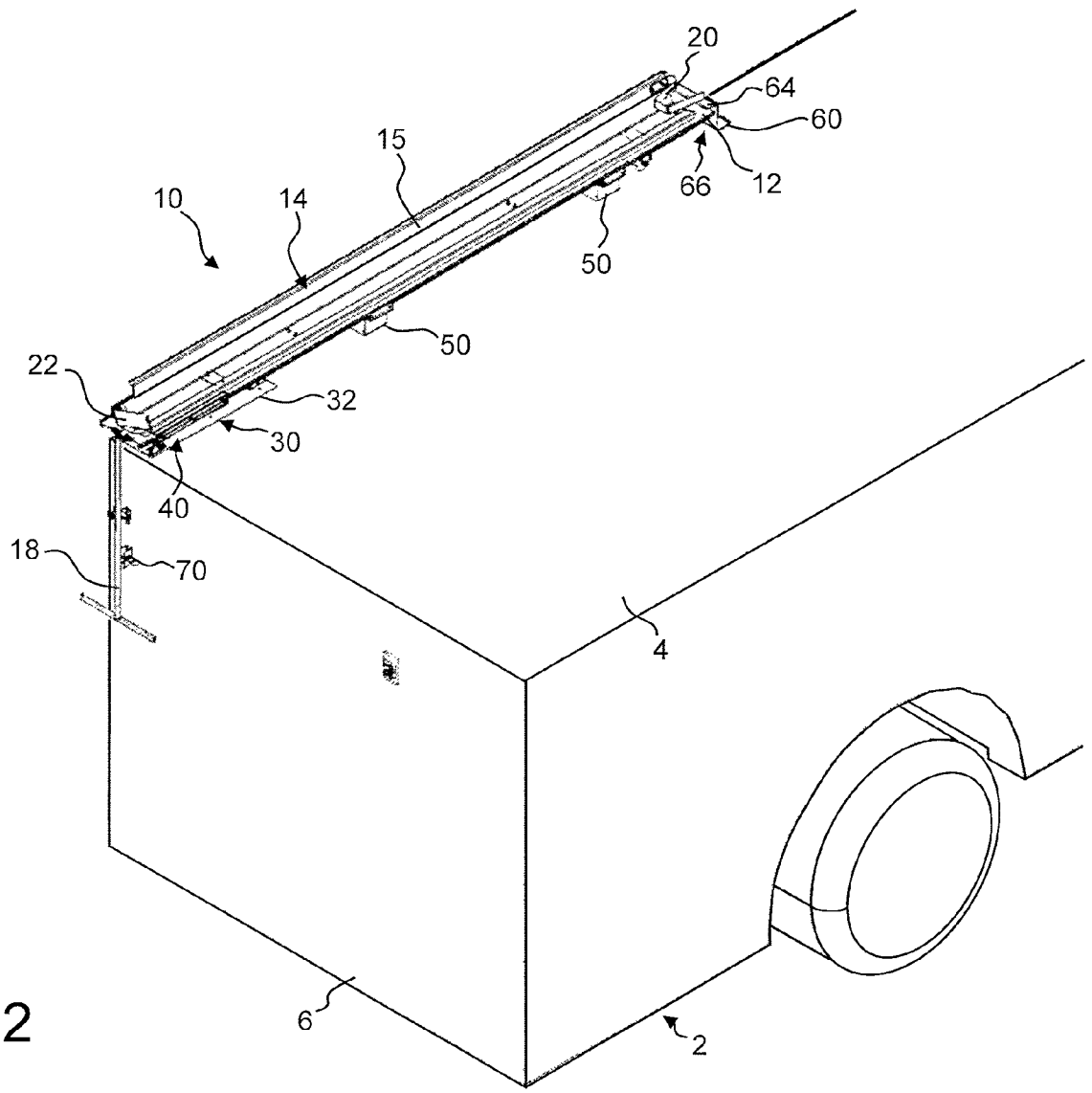
FIG. 2 is a top perspective three-quarter view of an embodiment of the storage apparatus of the present invention for retaining a suction hose on top of an emergency vehicle which shows the apparatus in an upper storage position with the handle member secured with respect to a handle securement bracket which is mounted on a vertically extending body panel of the emergency vehicle.

An exemplary movement of the storage carriage 12 from the storage position of FIG. 2 to the access position of FIG. 4 will be described. Manual movement of the support carriage 12 is enhanced by the inclusion of a handle 18. This handle 18 is preferably pivotally connected with respect to the rearmost portion of the support carriage 12 and in this manner the handle 18 can be grasped by a single emergency person for powering movement of the storage apparatus of the present invention from the storage position to the access position as shown in FIG. 4 or in the opposite direction for movement from the access position to the storage position.

When the support carriage 12 is in the storage position, the handle 18 be capable of extending downwardly parallel to and immediately adjacent to the vertical body panel 6 which is preferably the rear vertical facing of the fire tuck or other emergency vehicle. Preferably a handle securement bracket 70 is mounted to the rear vertical body panel 6 for the purpose of securing the handle 18 in place and helping to secure the storage apparatus 10 with respect to the emergency vehicle 2.

Figure 3:
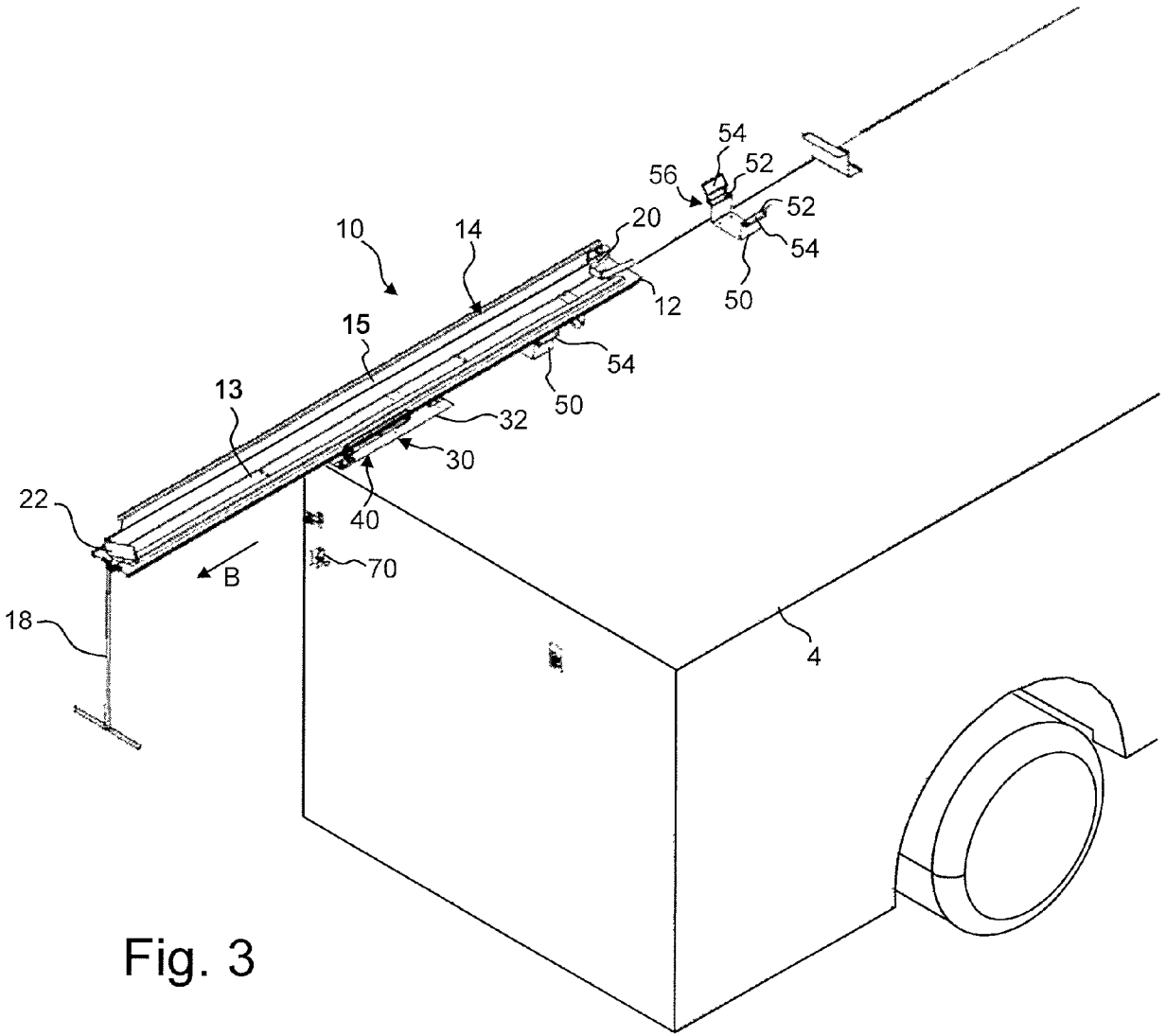
FIG. 3 is an illustration similar to FIG. 2 but with the apparatus shown in an intermediate position between the upper storage position and the lower access position.

To move the storage carriage 12 from the upper storage position to the access position, a user grasps the handle 18 and moves the support carriage 12 longitudinally as indicated by arrow B in FIG. 3. During this initial stage of movement, the carriage 12 moves within the guide slot 47 with much of the weight still supported on the vehicle by contact of the guide wheel 26 thereon and contact of the carriage with the saddle supports 50. As the support carriage 12 is moved further rearwardly relative to the guide track 40, the center of gravity of the support carriage will pass the guide track 40 and the guide track 40 will begin to naturally pivot such that the rearward end of the storage carriage 12 moves downward as indicated by arrow C in FIG. 4. The user can assist the motion with the handle 18. With the storage carriage 12 in the access position, the user can easily access the hose 100.

When it is desired to store the hose 100, it is positioned in the receiving area 16 while the storage carriage 12 is in the access position. The user then uses the handle 18 to move the carriage 12 forward with the carriage 12 sliding in the guide slot 37 of the guide track 40. During the initial movement, the guide track 40 can remain pivoted such that the user does not have to push forward and lift at the same time. Once the center of gravity of the storage carriage 12 reaches the guide track 40, the guide track 40 will naturally pivot toward the storage position. Pneumatics, springs or the like in the telescoping member 42 may assist with such pivoting.

T These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A hose storage apparatus comprising:

a base plate configured to be secured to a top surface of a vehicle;

a guide track comprising a base surface and a pair of opposing side walls each extending from the base surface and returning inward such that a guiding slot is defined between the base surface and the opposing side walls and the returns, wherein the guide track is pivotally connected to the base plate;

a storage carriage having an upper surface, wherein at least a portion of the storage carriage is retained in the guide slot such that the storage carriage is moveable along the guide slot;

an L-shape tray having a horizontal surface and a size wall, the horizontal surface and the size wall defining a linear hose receiving area, the L-shape tray securing to the upper surface of the storage carriage such that the storage carriage and the L-shape tray are moveable between a storage position wherein the storage carriage is positioned above and substantially parallel to the base plate and an access position wherein the storage carriage is pivoted relative to the base plate and at least a portion of the linear hose receiving area is positioned below the base plate.

2. The hose storage apparatus of claim 1 wherein a rearward end of the guide track is pivotally connected to the base plate.

3. The hose storage apparatus of claim 2 wherein a telescoping member is pivotally connected between a forward end of the guide track and the base plate.

4. The hose storage apparatus of claim 3 wherein the telescoping member includes a pneumatic chamber.

5. The hose storage apparatus of claim 3 wherein the telescoping member includes a spring configured to bias the forward end of the guide track toward the base plate.

6. The hose storage apparatus of claim 1 wherein a handle is pivotally connected proximate a rearward end of the storage carriage.

7. The hose storage apparatus of claim 1 wherein a guide wheel extends from a lower surface of the storage carriage proximate a forward end thereof.

8. The hose storage apparatus of claim 1 said L-shaped tray includes a base surface and a side wall.

9. The hose storage apparatus of claim 8 wherein a first retaining member extends from the L-shaped tray side wall proximate a forward end of the L-shaped tray and a second retaining member extends from the L-shaped tray side wall proximate a rear end of the L-shaped tray.

10. The hose storage apparatus of claim 9 wherein the first retaining member has a v-shape extending from the side wall of the L-shaped tray toward the rear end of the L-shaped tray.

11. The hose storage apparatus of claim 9 wherein the second retaining member has a generally planar configuration and extends substantially perpendicular to the side wall.

12. The hose storage apparatus of claim 11 wherein the second retaining member is made from a flexible material.

13. A vehicle assembly comprising:

an emergency vehicle defining the top surface; and a hose storage apparatus of claim 1.

14. The vehicle assembly of claim 13 wherein the emergency vehicle is a fire truck.

15. The vehicle assembly of claim 13 wherein the hose storage apparatus further comprises at least one saddle support attached to the top surface forward of the base plate.

16. The vehicle assembly of claim 13 wherein the hose storage apparatus further comprises an end bracket positioned at the approximate forwardmost position of the support carriage forward end when the support carriage is in the storage position.

17. The vehicle assembly of claim 13 wherein the emergency vehicle defines a vertical surface extending from the top surface and a handle bracket is positioned on the vertical surface and is configured to lockingly receive a handle pivotally connected proximate a rearward end of the storage carriage.

18. A hose storage apparatus comprising:

a base plate configured to be secured to a top surface of a vehicle;

a guide track defining a guide slot, the guide track pivotally connecting to the base plate;

a storage carriage supporting an L-shape tray secured thereon, the L-shape tray defining a linear hose receiving area, the storage carriage being retained in and movable along the guide slot, wherein the storage carriage and the L-shape tray are moveable between a storage position wherein the linear hose receiving area is positioned above and substantially parallel to the base plate and an access position wherein the storage carriage is pivoted relative to the base plate and at least a portion of the linear hose receiving area is positioned below the base plate; and a handle pivotally connected proximate a rearward end of the storage carriage and configured to:

be grasped by a user to move the support carriage longitudinally along the guide track, and extend downwardly parallel to and immediately adjacent to a vertical body panel of the vehicle below the top surface to be received in a securement bracket, wherein the securement bracket is mounted to the vertical body panel so that the handle and the storage carriage are secured in place with respect to the vehicle.

* * * * *